US006179504B1

(12) United States Patent
Jones

(10) Patent No.: US 6,179,504 B1
(45) Date of Patent: Jan. 30, 2001

(54) COMBINATION LOTION DISPENSER AND PEN

(76) Inventor: Susana Jones, 102 St. Marks Ave., Brooklyn, NY (US) 11217

( * ) Notice: Under 35 U.S.C. 154(b), the term of this patent shall be extended for 0 days.

(21) Appl. No.: 09/505,526

(22) Filed: Feb. 17, 2000

Related U.S. Application Data

(60) Provisional application No. 60/124,312, filed on Mar. 12, 1999.

(51) Int. Cl.[7] ..... B43K 29/00
(52) U.S. Cl. ..... 401/195; D19/44; D19/46
(58) Field of Search ..... 401/195, 52; D19/44, D19/46

(56) References Cited

U.S. PATENT DOCUMENTS

| | | | | |
|---|---|---|---|---|
| D. 396,884 | * | 8/1998 | Davila | D19/46 X |
| 1,307,195 | * | 6/1919 | Gardner | D19/46 X |
| 2,354,402 | * | 7/1944 | Petruccione et al. | 401/195 X |
| 3,576,374 | * | 4/1971 | Lile | 401/52 |

FOREIGN PATENT DOCUMENTS

2106043 * 4/1983 (GB) .

* cited by examiner

*Primary Examiner*—Henry J. Recla
*Assistant Examiner*—Kathleen J. Prunner
(74) *Attorney, Agent, or Firm*—Goldstein & Canino

(57) ABSTRACT

A combination lotion dispenser and pen including a housing having a truncated upper end, an arcuate lower end and a tubular intermediate portion therebetween. The truncated upper end has an internally threaded recess formed therein. The arcuate lower end has an elongated bore extending inwardly thereof. A pen cartridge is removably received within the elongated bore. A bulbous rubber container is coupled with respect to the housing. The container has a threaded extension disposed on a lower end thereof for coupling with the internally threaded recess of the truncated upper end of the housing. The container has an opening through an upper end thereof. The opening has a cap removably coupled therewith. The container has a dispensing hole within a side wall thereof whereby lotion within the container will dispense outwardly thereof upon squeezing of the container.

6 Claims, 2 Drawing Sheets

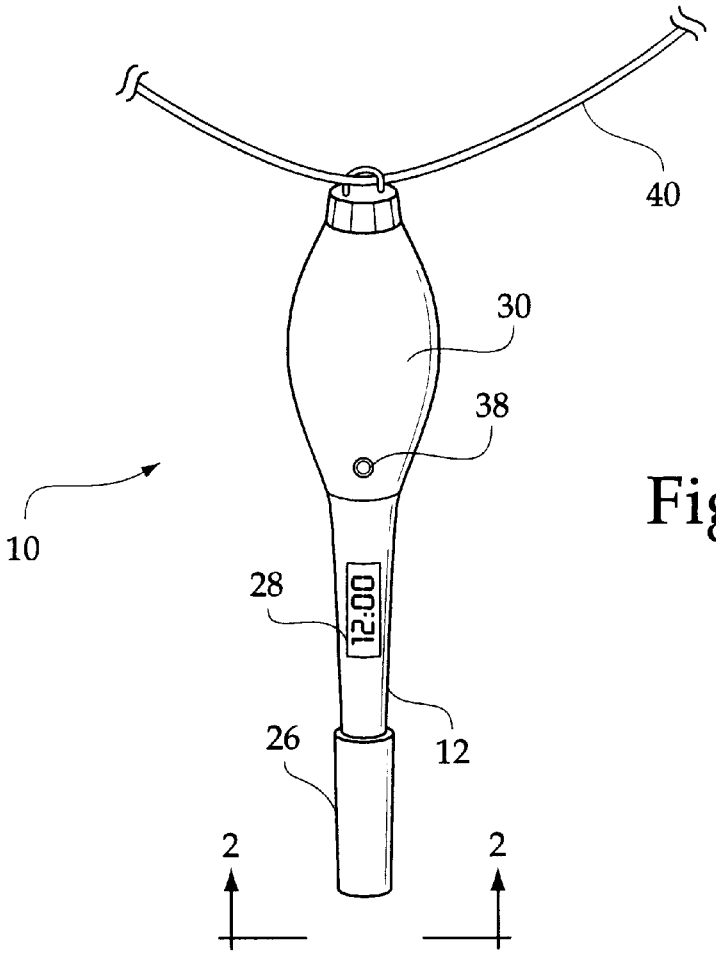
Fig. 1
Fig. 2
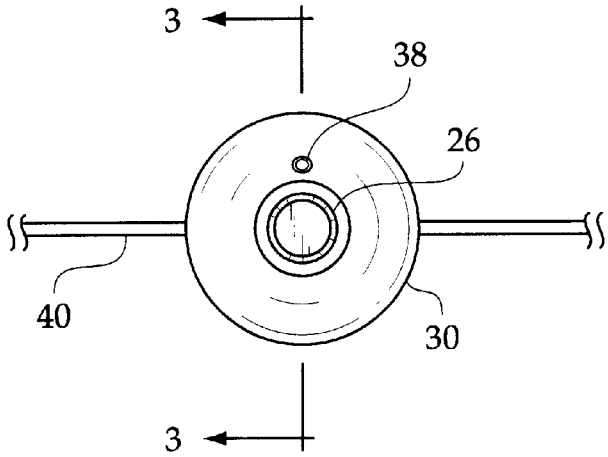

COMBINATION LOTION DISPENSER AND PEN

CROSS REFERENCES AND RELATED SUBJECT MATTER

This application relates to subject matter contained in provisional patent application serial number 60/124,312, filed in the United States Patent & Trademark Office on Mar. 12, 1999.

BACKGROUND OF THE INVENTION

The present invention relates to a combination lotion dispenser and pen and more particularly pertains to providing a writing instrument that also dispenses lotion and tells time and can be worn around a wearer's neck.

The use of lotion applicators is known in the prior art. More specifically, lotion applicators heretofore devised and utilized for the purpose of applying lotion are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,018,543 to Martinez discloses a cylindrical container for aftershave lotion. U.S. Pat. No. 5,185,942 to Decker discloses a lotion containing apparatus in which the lotion is contained in the upper and lower shoe sole. U.S. Pat. No. Des. 302,244 to North discloses an ornamental design for a lotion container.

While these devices fulfill their respective, particular objective and requirements, the aforementioned patents do not describe a combination lotion dispenser and pen for providing a writing instrument that also dispenses lotion and tells time and can be worn around a wearer's neck.

In this respect, the combination lotion dispenser and pen according to the present invention substantially departs from the conventional concepts and designs of the prior art, and in doing so provides an apparatus primarily developed for the purpose of providing a writing instrument that also dispenses lotion and tells time and can be worn around a wearer's neck.

Therefore, it can be appreciated that there exists a continuing need for new and improved combination lotion dispenser and pen which can be used for providing a writing instrument that also dispenses lotion and tells time and can be worn around a wearer's neck. In this regard, the present invention substantially fulfills this need.

SUMMARY OF THE INVENTION

In the view of the foregoing disadvantages inherent in the known types of lotion applicators now present in the prior art, the present invention provides an improved combination lotion dispenser and pen. As such, the general purpose of the present invention, which will be described subsequently in greater detail, is to provide a new and improved combination lotion dispenser and pen and method which has all the advantages of the prior art and none of the disadvantages.

To attain this, the present invention essentially comprises a housing having a truncated upper end, an arcuate lower end and a tubular intermediate portion therebetween. The truncated upper end has an internally threaded recess formed therein. The arcuate lower end has an elongated bore extending inwardly thereof. A pen cartridge is removably received within the elongated bore. The pen cartridge has a cap removably disposed thereover. A clock is secured within the tubular intermediate portion of the housing. The clock has an LED disposed therein. A bulbous rubber container is coupled with respect to the housing. The container has a threaded extension disposed on a lower end thereof for coupling with the internally threaded recess of the truncated upper end of the housing. The container has an opening through an upper end thereof. The opening has a cap removably coupled therewith. The cap has an eyelet disposed on an outer surface thereof. The container has a dispensing hole within a side wall thereof whereby lotion within the container will dispense outwardly thereof upon squeezing of the container. An elastic necklace is coupled with the eyelet of the container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination lotion dispenser and pen which has all the advantages of the prior art lotion applicators and none of the disadvantages.

It is another object of the present invention to provide a new and improved combination lotion dispenser and pen which may be easily and efficiently manufactured and marketed.

It is a further object of the present invention to provide a new and improved combination lotion dispenser and pen which is of durable and reliable construction.

An even further object of the present invention is to provide a new and improved combination lotion dispenser and pen which is susceptible of a low cost of manufacture with regard to both materials and labor, and which accordingly is then susceptible of low prices of sale to the consuming public, thereby making such a combination lotion dispenser and pen economically available to the buying public.

Even still another object of the present invention is to provide a new and improved combination lotion dispenser and pen for providing a writing instrument that also dispenses lotion and tells time and can be worn around a wearer's neck.

Lastly, it is an object of the present invention to provide a new and improved combination lotion dispenser and pen including a housing having a truncated upper end, an arcuate lower end and a tubular intermediate portion therebetween.

The truncated upper end has an internally threaded recess formed therein. The arcuate lower end has an elongated bore extending inwardly thereof. A pen cartridge is removably received within the elongated bore. A bulbous rubber container is coupled with respect to the housing. The container has a threaded extension disposed on a lower end thereof for coupling with the internally threaded recess of the truncated upper end of the housing. The container has an opening through an upper end thereof. The opening has a cap removably coupled therewith. The container has a dispensing hole within a side wall thereof whereby lotion within the container will dispense outwardly thereof upon squeezing of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the combination lotion dispenser and pen constructed in accordance with the principles of the present invention.

FIG. 2 is a bottom plan view of the present invention as taken along line 2—2 of FIG. 1.

The same reference numerals refer to the same parts through the various figures.

DESCRIPTION OF THE PREFERRED EMBODIMENT

Figure 3:
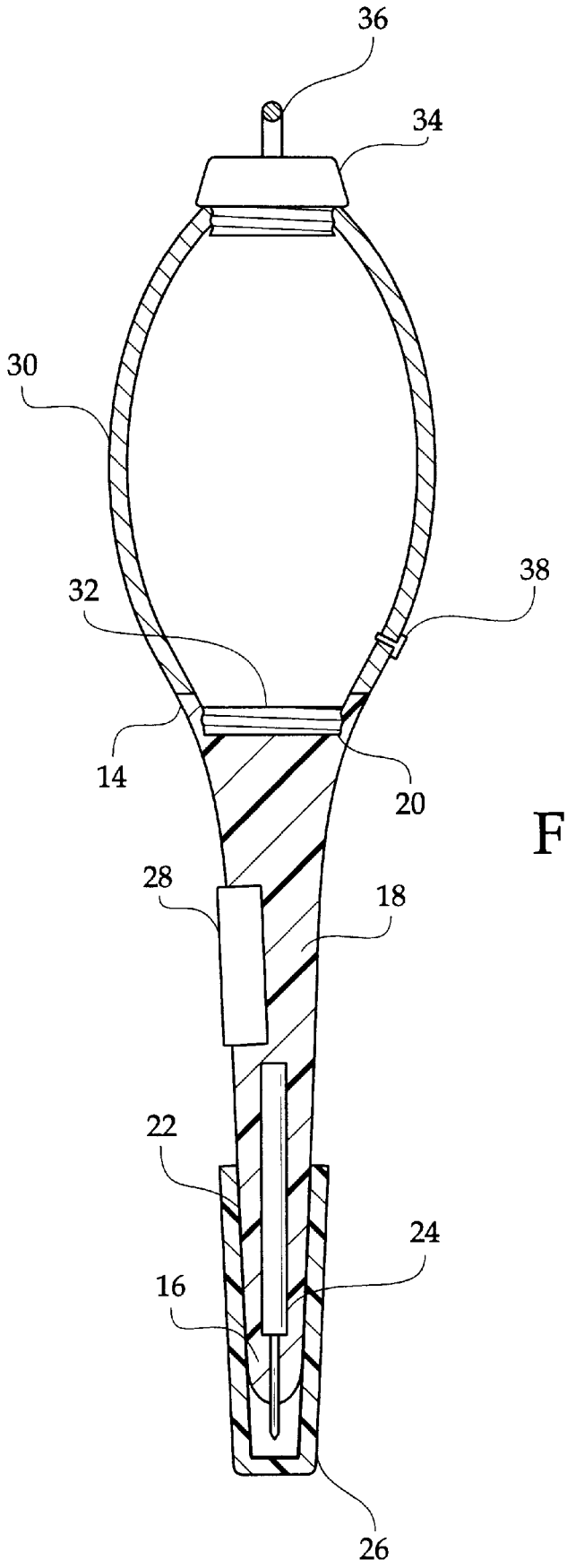
FIG. 3 is a cross-sectional view of the present invention as taken along line 3—3 of FIG. 2.

With reference now to the drawings, and in particular, to FIGS. 1 through 3 thereof, the preferred embodiment of the new and improved combination lotion dispenser and pen embodying the principles and concepts of the present invention and generally designated by the reference number 10 will be described.

Specifically, it will be noted in the various Figures that the device relates to a combination lotion dispenser and pen for providing a writing instrument that also dispenses lotion and tells time and can be worn around a wearer's neck. In its broadest context, the device consists of a housing, a pen cartridge, a clock, a bulbous rubber container, and an elastic necklace. Such components are individually configured and correlated with respect to each other so as to attain the desired objective.

The housing 12 has a truncated upper end 14, an arcuate lower end 16 and a tubular intermediate portion 18 therebetween. The truncated upper end 14 has an internally threaded recess 20 formed therein. The arcuate lower end 16 has an elongated bore 22 extending inwardly thereof.

The pen cartridge 24 is removably received within the elongated bore 22. The pen cartridge 24 has a cap 26 removably disposed thereover. Thus, once the pen cartridge 24 is empty of ink, a new cartridge can be put in its place.

The clock 28 is secured within the tubular intermediate portion 18 of the housing 12. The clock 28 has an LED disposed therein.

The bulbous rubber container 30 is coupled with respect to the housing 12. The container 30 has a threaded extension 32 disposed on a lower end thereof for coupling with the internally threaded recess 20 of the truncated upper end 14 of the housing 12. The container 30 has an opening through an upper end thereof. The opening has a cap 34 removably coupled therewith. The cap 34 is easily removable to allow for the container 30 to be filled with lotion. The cap 34 has an eyelet 36 disposed on an outer surface thereof. The container 30 has a dispensing hole 38 within a side wall thereof whereby lotion within the container 30 will dispense outwardly thereof upon squeezing of the container 30.

The elastic necklace 40 is coupled with the eyelet 36 of the container 30. The necklace 40 allows for the device 10 to worn around a user's neck.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination lotion dispenser and pen for providing a writing instrument that also dispenses lotion and tells time and can be worn around a wearer's neck comprising, in combination:

a housing having a truncated upper end, an arcuate lower end and a tubular intermediate portion therebetween, the truncated upper end having an internally threaded recess formed therein, the arcuate lower end having an elongated bore extending inwardly thereof;

a pen cartridge removably received within the elongated bore, the pen cartridge having a cap removably disposed thereover;

a clock secured within the tubular intermediate portion of the housing, the clock having an LED disposed therein;

a bulbous rubber container coupled with respect to the housing, the container having a threaded extension disposed on a lower end thereof for coupling with the internally threaded recess of the truncated upper end of the housing, the container having an opening through an upper end thereof, the opening having a cap removably coupled therewith, the cap having an eyelet disposed on an outer surface thereof, the container having a dispensing hole within a side wall thereof whereby lotion within the container will dispense outwardly thereof upon squeezing of the container;

an elastic necklace coupled with the eyelet of the container.

2. A combination lotion dispenser and pen for providing a writing instrument that also dispenses lotion comprising, in combination:

a housing having a truncated upper end, an arcuate lower end and a tubular intermediate portion therebetween, the truncated upper end having an internally threaded recess formed therein, the arcuate lower end having an elongated bore extending inwardly thereof;

a pen cartridge removably received within the elongated bore;

a bulbous rubber container coupled with respect to the housing, the container having a threaded extension disposed on a lower end thereof for coupling with the internally threaded recess of the truncated upper end of the housing, the container having an opening through an upper end thereof, the opening having a cap removably coupled therewith, the container having a dispensing hole within a side wall thereof whereby lotion within the container will dispense outwardly thereof upon squeezing of the container.

3. The combination lotion dispenser and pen as set forth in claim 2 wherein the pen cartridge has a cap removably disposed thereover.

4. The combination lotion dispenser and pen as set forth in claim 2 and further including a clock secured within the tubular intermediate portion of the housing.

5. The combination lotion dispenser and pen as set forth in claim 4 wherein the clock has an LED disposed therein.

6. The combination lotion dispenser and pen as set forth in claim 2 and further including an elastic necklace coupled with an eyelet secured to the cap of the container.

* * * * *